US006220905B1

(12) United States Patent
Blanchard

(10) Patent No.: US 6,220,905 B1
(45) Date of Patent: Apr. 24, 2001

(54) TILT-TRIM SUBSYSTEM FOR MARINE PROPULSION SYSTEMS

(75) Inventor: Clarence Blanchard, Pleasant Prairie, WI (US)

(73) Assignee: Outboard Marine Corporation, Waukegan, IL (US)

( * ) Notice: Subject to any disclaimer, the term of this patent is extended or adjusted under 35 U.S.C. 154(b) by 0 days.

(21) Appl. No.: 09/458,284

(22) Filed: Dec. 10, 1999

(51) Int. Cl.[7] ..... B63H 5/125
(52) U.S. Cl. ..... 440/61; 440/63
(58) Field of Search ..... 440/53, 61, 63

(56) References Cited

U.S. PATENT DOCUMENTS

| | | | |
|---|---|---|---|
| 4,064,824 | 12/1977 | Hall et al. | 440/61 |
| 4,096,820 | 6/1978 | Hall et al. | 440/61 |
| 4,354,848 | 10/1982 | Hall et al. | 440/61 |
| 4,362,513 | 12/1982 | Hall et al. | 440/61 |
| 4,363,629 | 12/1982 | Hall et al. | 440/61 |
| 4,373,921 | 2/1983 | Hall et al. | 440/61 |
| 4,384,856 | 5/1983 | Hall et al. | 440/61 |
| 4,395,239 | 7/1983 | Hall et al. | 440/61 |
| 4,449,945 | 5/1984 | Ferguson | 440/61 |
| 4,498,871 | 2/1985 | Hall et al. | 440/61 |
| 4,504,237 | 3/1985 | Blanchard et al. | 440/61 |
| 4,551,105 | 11/1985 | Hall et al. | 440/61 |
| 5,169,350 * | 12/1992 | Tsujii | 440/61 |
| 5,195,914 | 3/1993 | Binversie et al. | 440/61 |
| 5,372,528 | 12/1994 | Nakamura et al. | 440/61 |
| 5,547,407 * | 8/1996 | Peirce | 440/61 |

* cited by examiner

*Primary Examiner*—Jesus D. Sotelo
(74) *Attorney, Agent, or Firm*—Enrique J. Mora; Robert W. Duckworth; Holland & Knight LLP

(57) ABSTRACT

A tilt-trim subsystem and method for a boat propulsion system is provided. A stern bracket is mounted on a transom of the boat. A swivel bracket is pivotally supported relative to the stern bracket for rotation about a generally horizontal axis. The subsystem includes a tilt and trim assembly having at least one cam pivotally supported by the stern bracket. The cam is configured to impart a relatively slow rate of rotation to the swivel bracket, at least when there is driving contact between the cam and the swivel bracket within a predetermined angular range for trimming, as compared to a rate of rotation within a predetermined angular range for tilting.

70 Claims, 2 Drawing Sheets

TILT-TRIM SUBSYSTEM FOR MARINE PROPULSION SYSTEMS

BACKGROUND OF THE INVENTION

The invention relates generally to marine propulsion systems and, more particularly, to outboard motors including propulsion units which are steerable in a generally horizontal plane and tiltable in a generally vertical plane.

The invention also relates to tilt/trim subsystems for power tilting/trimming of propulsion units between a lower normal running position in which the propeller is submerged in water, and a tilted or raised position in which the propeller is located for above-the-water accessibility.

Relatively small vessels, such as motor boats or the like, generally use a tilt-trim subsystem. Known tilt-trim subsystems typically comprise a tilt cylinder unit for swinging a swivel bracket through a relatively large angle to lift the lower portion of the outboard motor above the water level or, conversely, lower the outboard motor below the water level. Such subsystems may further comprise a distinct trim cylinder unit for angularly moving the swivel bracket through a relatively small angle to trim the outboard motor while the lower portion thereof is being submerged. One desirable characteristic of a tilt-trim subsystem would be to provide a slower rate of rotation during trimming to retain the propulsion unit in water for a longer interval during movement thereof through a predetermined angular trim range and thereafter to more rapidly elevate the propulsion unit from the water so as to reach a full tilt-up position. Unfortunately, previous tilt-trim subsystems, as suggested above, may require use of distinct tilt and trim cylinder units or have required use of fairly complex mechanical structures to somewhat meet the tilt-trim requirements of the propulsion unit. Thus, it would be desirable to provide a single cylinder/piston subassembly that would allow to meet the trim-tilt requirements of the propulsion unit. It would be further desirable for that subassembly to provide a relatively slower rate of rotation during trimming, as compared to the rate of rotation used to reach a fully tilt-up position. The tilt-trim subsystem should allow for a low-cost and uncomplicated mechanical installation capable of being installed in kit form and capable of being serviced without requiring substantial time and expenditures.

BRIEF SUMMARY OF THE INVENTION

Generally speaking the present invention fulfills the foregoing needs by providing a tilt-trim subsystem for a boat propulsion system. The propulsion system may include a stern bracket mounted on a transom of the boat. A swivel bracket is pivotally supported relative to the stern bracket for rotation about a generally horizontal axis. The subsystem may include a tilt and trim assembly having at least one cam pivotally supported by the stern bracket. The cam is configured to impart a relatively slow rate of rotation to the swivel bracket, at least when there is driving contact between the cam and the swivel bracket within a predetermined angular range for trimming, as compared to a rate of rotation within a predetermined angular range for tilting.

The present invention further fulfills the foregoing needs by providing a marine propulsion system having a stern bracket mounted on a transom of the boat. A swivel bracket is pivotally supported relative to the stern bracket for rotation about a generally horizontal axis. The propulsion system further includes a tilt and trim assembly having at least one cam pivotally supported by the stern bracket. The cam is configured to impart a relatively slow rate of rotation to the swivel bracket, at least when there is driving contact between the cam and the swivel bracket within a predetermined angular range for trimming, as compared to a rate of rotation within a predetermined angular range for tilting.

BRIEF DESCRIPTION OF THE DRAWINGS

The features and advantages of the present invention will become apparent from the following detailed description of the invention when read with the accompanying drawings in which.

Figure 1:
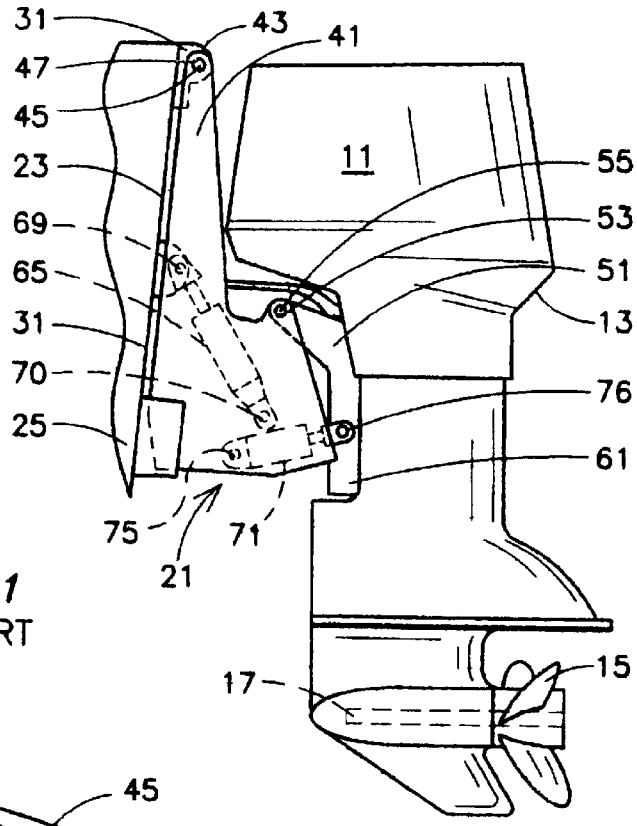
FIG. 1 PRIOR ART
FIG. 1 is a side elevational view of an exemplary outboard motor incorporating a prior art tilt/trim subsystem.

Before explaining one embodiment of the invention in detail, it is to be understood that the invention is not limited in its application to the details of construction and the arrangement of components set forth in the following description or illustrated in the drawings. The invention may be capable of other embodiments and of being practiced and carried out in various ways. Also, it is to be understood that the phraseology and terminology employed herein is for the purpose of description and should not be regarded as limiting.

DETAILED DESCRIPTION OF THE INVENTION

FIG. 1 illustrates an exemplary prior art marine propulsion system in the form of an outboard motor 11 having a standard propulsion unit 13 including, at the lower end thereof, a rotatably mounted propeller 15 driven by a propeller shaft 17 to develop thrust to propel a boat 25 in a desired direction. The outboard motor 11 also includes means 21 for pivotally mounting the propulsion unit 13 for pivotal movement in both the horizontal and vertical planes relative to a transom 23 of the boat 25, to provide for steering movement of the propulsion unit 13 in the horizontal plane, and to provide for movement in the vertical plane of the propulsion unit 13 between a lowermost position with the propeller 15 fully submerged in water for driving propulsion and a raised position affording above-water accessibility to the propeller 15.

The means 21 for pivotally mounting the propulsion unit 13 includes a transom bracket means 31 adapted to be fixedly mounted on the transom 23 of the boat 25. The means 21 for pivotally mounting the propulsion unit 13 also includes a stern bracket 41 having an upper end 43, as well as first or upper pivot means 45 located rearwardly of the boat transom 23 and connecting the upper end 43 of the stern bracket 41 to the transom bracket means 31 for pivotal movement of the stern bracket 41 about a first or upper pivot axis 47 which is horizontal when the transom bracket means 31 is boat mounted. The means 21 for pivotally mounting the propulsion unit 13 further includes a swivel bracket 51, together with a lower or second pivot means 53 connecting the swivel bracket 51 to the stern bracket 41 at a point below the first pivot means 45 for pivotal movement of the swivel bracket 51 relative to the stern bracket 41 about a second or lower pivot axis 55 which is parallel to the first or upper pivot axis 47.

The outboard motor 11 also includes means for displacing the swivel bracket 51 and connected propulsion unit 13 about the lower horizontal pivot axis 55 and about the upper horizontal pivot axis 47. As seen in FIG. 1, such means comprises one or more tilt hydraulic cylinder-piston subassemblies 65. One end 69 is pivotally connected to the transom bracket means 31 and the other end 70 is pivotally connected to the stern bracket 41. In addition, the means for pivotally displacing the swivel bracket 51 and connected propulsion unit 13 includes one or more trim cylinder-piston subassemblies 71. One end 75 is pivotally connected, by any suitable means, to the stern bracket 41, and the other end 76 is pivotally connected, by any suitable means, to the swivel bracket 51. Thus, as suggested above, typical presently available outboard arrangements generally comprise distinct trim and tilt piston/cylinder subassemblies for pivoting the propulsion unit. In particular, the trim subassembly when actuated allows for trimming the engine by changing its angle position relative to the transom of the boat. The tilt subassembly when actuated allows to further change the angle to the full tilt up position.

Figure 2:
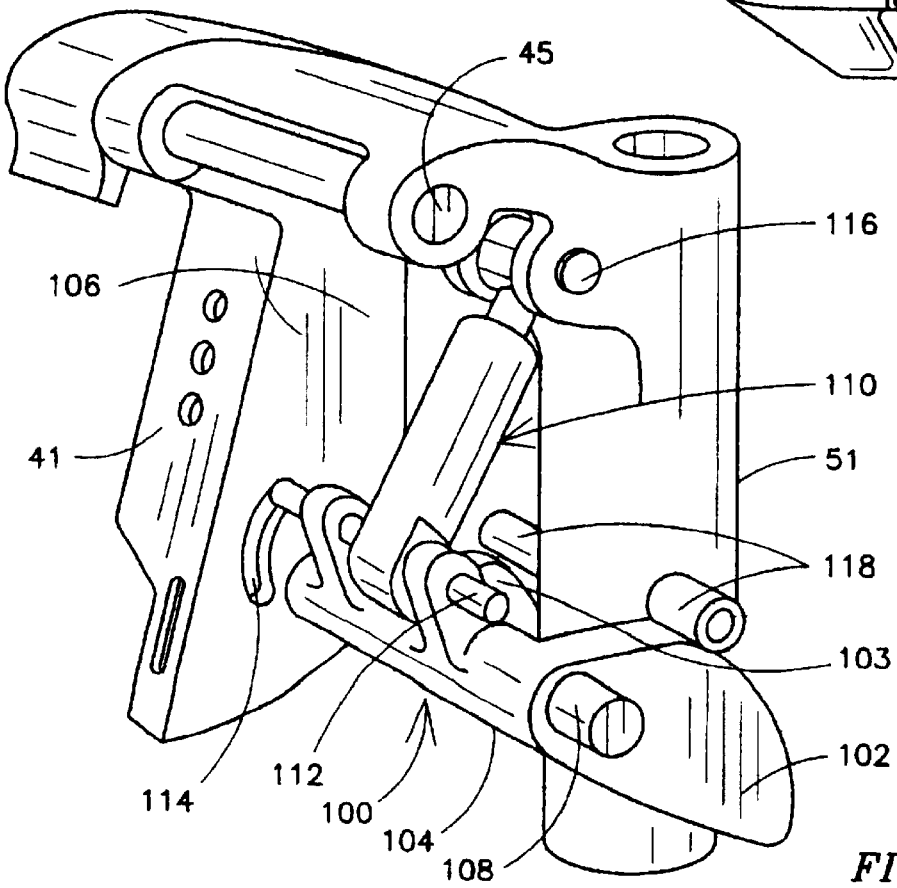
FIG. 2 illustrates an isometric view of an exemplary embodiment of the tilt/trim subsystem of the present invention.

FIG. 2 illustrates an exemplary embodiment of a tilt-trim subsystem 100 embodying features of the present invention. As shown in FIG. 2, tilt-trim subsystem 100 includes at least one cam 102 extending from one end of a cam support stud 104 supported by the stern bracket 41. Cam support stud 104 is pivotally mounted between respective side walls 106 (one of which is seen in FIG. 2) of the stern bracket 41 by means of respective pivot studs 108. It will be appreciated that, depending on the size of the load to be driven, another cam 103 could similarly extend from the respective opposite end of cam support stud 104 so as to provide more symmetrical load distribution. It will be further appreciated that cams 102 and 103 together with cam support stud 104 may comprise a unitized body, such as may be achieved using well-understood casting techniques. Alternatively, each of cams 103 and 103 could constitute an individual part that could be respectively affixed to cam support stud 104 using bolts or any other means for mechanically affixing two components to one another.

A cylinder/piston subassembly 110 that may be actuated in response to a pressurized fluid, such as hydraulic or pneumatic fluid, is pivotally supported onto support stud 104 by means of a lower pivot pin 112. Pivot pin 112 also extends into generally arcuated slots 114 configured in the side walls of stern bracket 41. It will be appreciated that the respective ends of slots 114 allow for limiting the rotation of cam support stud 104 and consequently the rotation of cam 102. The opposite end of cylinder/piston subassembly 110 is pivotally mounted to swivel bracket 51 by means of an upper pivot pin 116. Swivel bracket 51 further includes rollers or bearings 118 that slidably ride on the surface of cam 102 at least when there is driving contact between the cam and the swivel bracket preferably within a predetermined angular range for trimming. It will now be appreciated by those skilled in the art that the curvature of the surface of the cam that contacts bearings 118 may be chosen using well-understood mechanical design techniques to impart a relatively slow rate of rotation to the swivel bracket, as compared to the rate of rotation that may be directly imparted by the piston within a predetermined angular range for tilting. As suggested above, this is a desirable feature being that a slower rate of rotation during trimming is desirable to retain the propulsion unit 13 (FIG. 1) in water for a longer interval during movement thereof through the predetermined angular trim range and thereafter to more rapidly elevate the propulsion unit 13 from the water so as to reach a full tilt-up position.

Figure 3A:
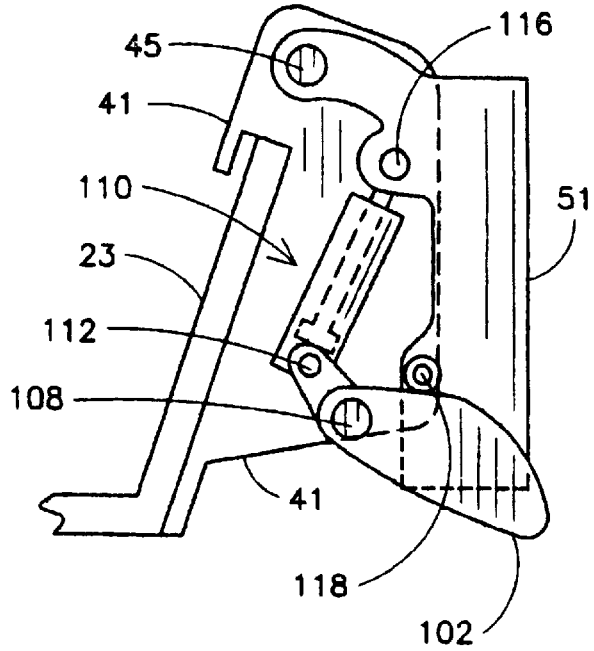
FIG. 3 is made up of three respective side elevational views that collectively illustrate exemplary details regarding the operation of the tilt/trim subsystem of FIG. 2
Figure 3B:
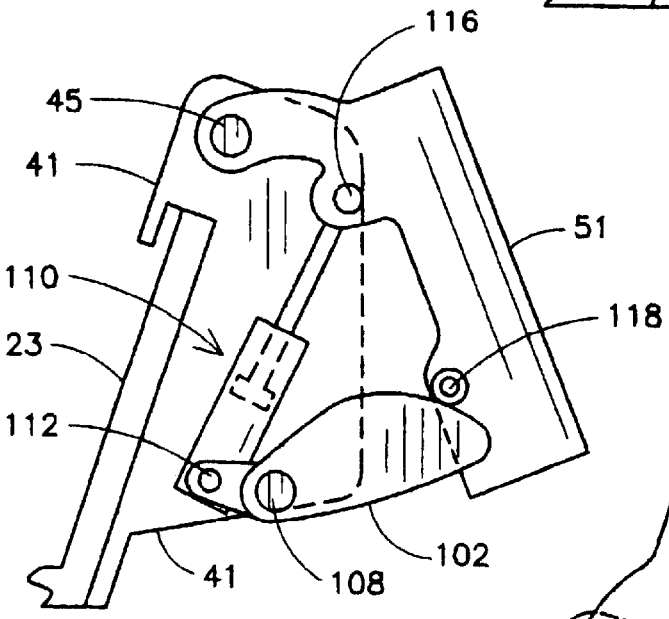
Figure 3C:
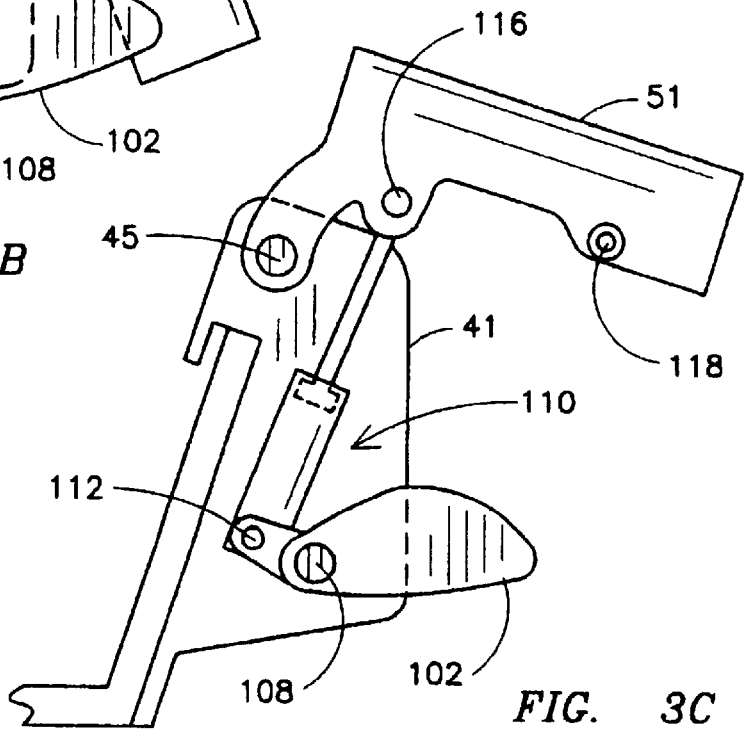

FIGS. 3A–3C collectively allow for illustrating respective operational details of the tilt-trim subassembly shown in FIG. 2. As shown in FIG. 3A, with the piston of subassembly 110 substantially retracted, the bearing 118 may be located at the upper portion of the cam surface that would drive swivel bracket 51 through the predetermined trim positions. FIG. 3B shows the piston of subassembly 110 upon reaching a partially extended position. In this case, the cam 102 has rotated through the predetermined angular range for trimming that may extend between the initial position illustrated in FIG. 3A and the intermediate position of FIG. 3B and the bearing 118 is about to lift up from the lower end of the cam driving surface. FIG. 3C shows the piston in a fully extended position so as to provide a full tilt-up to the propulsion unit. As suggested above, it will be appreciated that the use of the cam 102 and associated components allow for a slower rate of travel in the trim range and a faster rate of travel in the tilt range using a single cylinder/piston subassembly. This allows for an even more reliable and less costly propulsion system design that may be readily incorporated in new boat models or retrofitted in existing models as part of a replacement kit.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A tilt-trim subsystem for a boat propulsion system using a stern bracket mounted on a transom of the boat and further using a swivel bracket pivotally supported relative to the stern bracket for rotation about a generally horizontal axis, the tilt-trim subsystem comprising:

a tilt and trim assembly having at least one cam pivotally supported by the stern bracket, the cam configured to impart a relatively slow rate of rotation to the swivel bracket, at least when there is driving contact between the cam and the swivel bracket within a predetermined angular range for trimming, as compared to a rate of rotation within a predetermined angular range for tilting.

2. The subsystem of claim 1 wherein the swivel bracket has at least one roller positioned to be in slidable contact with a corresponding surface of the cam at least within the predetermined range for trimming.

3. The subsystem of claim 1 wherein the tilt and trim assembly further includes a cylinder and piston subassembly.

4. The subsystem of claim 3 wherein the cylinder and piston subassembly has one end thereof pivotally supported by a cam support stud traversing generally parallel to the horizontal axis between a pair of side walls of the stern bracket.

5. The subsystem of claim 4 wherein the cylinder and piston subassembly has another end thereof, opposite the one end supported by the cam support stud, pivotally supported by the swivel bracket.

6. The subsystem of claim 5 wherein the at least one cam extends from one end of the cam support stud.

7. The subsystem of claim 6 further comprising another cam extending from another end opposite the one end of the cam support stud.

8. The subsystem of claim 7 wherein the cam support stud and the respective cams extending therefrom comprise a unitized body.

9. The subsystem of claim 7 wherein the respective cams extending from the cam support stud are bolted to the respective ends of the cam support stud.

10. The subsystem of claim 4 wherein each of the stern bracket side walls has a respective slot for receiving a respective pivot pin mounted on the cam support stud.

11. The subsystem of claim 10 wherein the respective slot comprises arcuate slots.

12. The subsystem of claim 11 wherein the opposite ends of the arcuate slots define respective angular limits for cam travel within the predetermined trim range.

13. The subsystem of claim 3 wherein the cylinder-piston subassembly is responsive to a pressurized fluid so that the piston is extendable from a retracted position to at least a partially extended position to drive the swivel bracket through the cam at the relatively slow rate of rotation within the predetermined range for trimming.

14. The subsystem of claim 13 wherein the piston is further extendable from the partially extended position to a fully extended position to directly drive the swivel bracket at the relatively fast rate of rotation within the predetermined range for tilting.

15. A boat having an outboard propulsion system generally disposed aft of the boat transom, the propulsion system being rotatable about a predetermined tilt-trim axis to achieve a desired trim or tilt, comprising:

a stern bracket mounted on the transom of the boat;

a swivel bracket pivotally supported relative to the stern bracket for rotation about a generally horizontal axis;

a tilt and trim assembly having at least one cam pivotally supported by the stern bracket, the cam configured to impart a relatively slow rate of rotation to the swivel bracket, at least when there is driving contact between the cam and the swivel bracket within a predetermined angular range for trimming, as compared to a rate of rotation within a predetermined angular range for tilting; and a propulsion unit including an assembly for developing thrust, the propulsion unit supported by the swivel bracket for common movement therewith about the predetermined tilt-trim axis.

16. The boat of claim 15 wherein the swivel bracket has at least one roller positioned to be in slidable contact with a corresponding surface of the cam at least within the predetermined range for trimming.

17. The boat of claim 15 wherein the tilt and trim assembly further includes a cylinder and piston subassembly.

18. The boat of claim 17 wherein the cylinder and piston subassembly has one end thereof pivotally supported by a cam support stud traversing generally parallel to the horizontal axis between a pair of side walls of the stern bracket.

19. The boat of claim 18 wherein the cylinder and piston subassembly has another end thereof, opposite the one end supported by the cam support stud, pivotally supported by the swivel bracket.

20. The boat of claim 19 wherein the at least one cam extends from one end of the cam support stud.

21. The boat of claim 20 further comprising another cam extending from another end opposite the one end of the cam support stud.

22. The boat of claim 21 wherein the cam support stud and the respective cams extending therefrom comprise a unitized body.

23. The boat of claim 21 wherein the respective cams extending from the cam support stud are bolted to the respective ends of the cam support stud.

24. The boat of claim 18 wherein each of the stern bracket side walls has a respective slot for receiving a respective pivot pin mounted on the cam support stud.

25. The boat of claim 24 wherein the respective slot comprises arcuate slots.

26. The boat of claim 25 wherein the opposite ends of the arcuate slots define respective angular limits for cam travel within the predetermined trim range.

27. The boat of claim 17 wherein the cylinder-piston subassembly is responsive to a pressurized fluid so that the piston is extendable from a retracted position to at least a partially extended position to drive the swivel bracket through the cam at the relatively slow rate of rotation within the predetermined range for trimming.

28. The boat of claim 27 wherein the piston is further extendable from the partially extended position to a fully extended position to directly drive the swivel bracket at the relatively fast rate of rotation within the predetermined range for tilting.

29. A kit coupled to a propulsion system of a boat having stern bracket and a swivel bracket pivotally connected to one another for imparting a desired tilt or trim to the propulsion system, the kit comprising:

a tilt and trim assembly having at least one cam pivotally supported by the stern bracket, the cam configured to impart a relatively slow rate of rotation to the swivel bracket, at least when there is driving contact between the cam and the swivel bracket within a predetermined angular range for trimming, as compared to a rate of rotation within a predetermined angular range for tilting.

30. The kit of claim 29 wherein the swivel bracket has at least one roller positioned to be in slidable contact with a corresponding surface of the cam at least within the predetermined range for trimming.

31. The kit of claim 29 wherein the tilt and trim assembly further includes a cylinder and piston subassembly.

32. The kit of claim 31 wherein the cylinder and piston subassembly has one end thereof pivotally supported by a cam support stud traversing generally parallel to the horizontal axis between a pair of side walls of the stern bracket.

33. The kit of claim 32 wherein the cylinder and piston subassembly has another end thereof, opposite the one end supported by the cam support stud, pivotally supported by the swivel bracket.

34. The kit of claim 33 wherein the at least one cam extends from one end of the cam support stud.

35. The kit of claim 34 further comprising another cam extending from another end opposite the one end of the cam support stud.

36. The kit of claim 35 wherein the cam support stud and the respective cams extending therefrom comprise a unitized body.

37. The kit of claim 35 wherein the respective cams extending from the cam support stud are bolted to the respective ends of the cam support stud.

38. The kit of claim 32 wherein each of the stern bracket side walls has a respective slot for receiving a respective pivot pin mounted on the cam support stud.

39. The kit of claim 38 wherein the respective slot comprises arcuate slots.

40. The kit of claim 39 wherein the opposite ends of the arcuate slots define respective angular limits for cam travel within the predetermined trim range.

41. The kit of claim 31 wherein the cylinder-piston subassembly is responsive to a pressurized fluid so that the piston is extendable from a retracted position to at least a partially extended position to drive the swivel bracket through the cam at the relatively slow rate of rotation within the predetermined range for trimming.

42. The kit of claim 31 wherein the piston is further extendable from the partially extended position to a fully extended position to directly drive the swivel bracket at the relatively fast rate of rotation within the predetermined range for tilting.

43. A marine propulsion system comprising:

a stern bracket mounted on a transom of the boat;

a swivel bracket pivotally supported relative to the stern bracket for rotation about a generally horizontal axis; and a tilt and trim assembly having at least one cam pivotally supported by the stern bracket, the cam configured to impart a relatively slow rate of rotation to the swivel bracket, at least when there is driving contact between the cam and the swivel bracket within a predetermined angular range for trimming, as compared to a rate of rotation within a predetermined angular range for tilting.

44. The system of claim 43 wherein the swivel bracket has slidable means for providing driving contact with a corresponding surface of the cam at least within the redetermined range for trimming.

45. The system of claim 43 wherein the tilt and trim assembly further includes a cylinder and piston subassembly.

46. The system of claim 45 wherein the cylinder and piston subassembly has one end thereof pivotally supported by a cam support stud traversing generally parallel to the horizontal axis between a pair of side walls of the stern bracket.

47. The system of claim 46 wherein the cylinder and piston subassembly has another end thereof, opposite the one end supported by the cam support stud, pivotally supported by the swivel bracket.

48. The system of claim 47 wherein the at least one cam extends from one end of the cam support stud.

49. The system of claim 48 further comprising another cam extending from another end opposite the one end of the cam support stud.

50. The system of claim 49 wherein the cam support stud and the respective cams extending therefrom comprise a unitized body.

51. The system of claim 49 wherein the respective cams extending from the cam support stud are bolted to the respective ends of the cam support stud.

52. The system of claim 46 wherein each of the stern bracket side walls has a respective slot for receiving a respective pivot pin mounted on the cam support stud.

53. The system of claim 52 wherein the respective slot comprises arcuate slots.

54. The system of claim 53 wherein the opposite ends of the arcuate slots define respective angular limits for cam travel within the predetermined trim range.

55. The system of claim 45 wherein the cylinder-piston subassembly is responsive to a pressurized fluid so that the piston is extendable from a retracted position to at least a partially extended position to drive the swivel bracket through the cam at the relatively slow rate of rotation within the predetermined range for trimming.

56. The subsystem of claim 55 wherein the piston is further extendable from the partially extended position to a fully extended position to directly drive the swivel bracket at the relatively fast rate of rotation within the predetermined range for tilting.

57. A method for controlling tilt-trim in a boat propulsion system using a stern bracket mounted on a transom of the boat and further using a swivel bracket pivotally supported relative to the stern bracket for rotation about a generally horizontal axis, the method comprising:

providing a tilt and trim assembly having at least one cam pivotally supported by the stern bracket; and configuring the cam to impart a relatively slow rate of rotation to the swivel bracket, at least when there is driving contact between the cam and the swivel bracket within a predetermined angular range for trimming, as compared to a rate of rotation within a predetermined angular range for tilting.

58. The method of claim 57 further comprising a step of providing in the swivel bracket slidable means positioned to be in contact with a corresponding surface of the cam at least within the predetermined range for trimming.

59. The method of claim 57 wherein the tilt and trim assembly further includes a cylinder and piston subassembly.

60. The method of claim 59 further comprising a step of arranging the cylinder and piston subassembly to have one end thereof pivotally supported by a cam support stud traversing generally parallel to the horizontal axis between a pair of side walls of the stern bracket.

61. The method of claim 60 wherein the cylinder and piston subassembly is further arranged to have another end thereof, opposite the one end supported by the cam support stud, pivotally supported by the swivel bracket.

62. The method of claim 61 wherein the at least one cam extends from one end of the cam support stud.

63. The method of claim 62 further comprising extending another cam from another end opposite the one end of the cam support stud.

64. The method of claim 63 wherein the cam support stud and the respective cams extending therefrom comprise a unitized body.

65. The method of claim 63 wherein the respective cams extending from the cam support stud are bolted to the respective ends of the cam support stud.

66. The method of claim 59 further comprising a step of providing in each of the stern bracket side walls a respective slot for receiving a respective pivot pin mounted on the cam support stud.

67. The method of claim 66 wherein the respective slot comprises arcuate slots.

68. The method of claim 67 further comprising a step of arranging the opposite ends of the arcuate slots to provide respective angular limits for cam travel within the predetermined trim range.

69. The method of claim 59 further comprising a step of making the piston of the cylinder-piston subassembly extendable from a retracted position to at least a partially extended position to drive the swivel bracket through the cam at the relatively slow rate of rotation within the predetermined range for trimming.

70. The method of claim 69 wherein the piston is further extendable from the partially extended position to a fully extended position to directly drive the swivel bracket at the relatively fast rate of rotation within the predetermined range for tilting.

* * * * *